US008104423B2

(12) United States Patent
Cedoz et al.

(10) Patent No.: US 8,104,423 B2
(45) Date of Patent: Jan. 31, 2012

(54) COATING MATERIAL DISPENSING APPARATUS AND METHOD

(75) Inventors: Roger T. Cedoz, Curtice, OH (US); Peter Green, Staffordshire (GB)

(73) Assignee: Illinois Tool Works Inc., Glenview, IL (US)

( * ) Notice: Subject to any disclaimer, the term of this patent is extended or adjusted under 35 U.S.C. 154(b) by 679 days.

(21) Appl. No.: 11/775,481

(22) Filed: Jul. 10, 2007

(65) Prior Publication Data

US 2008/0149026 A1 Jun. 26, 2008

(30) Foreign Application Priority Data

Dec. 21, 2006 (GB) ..... 0625583.0

(51) Int. Cl.
*B05B 7/00* (2006.01)
*B05B 5/00* (2006.01)

(52) U.S. Cl. ..... 118/300; 239/700

(58) Field of Classification Search ..... 239/700; 118/300

See application file for complete search history.

(56) References Cited

U.S. PATENT DOCUMENTS

| | | | | |
|---|---|---|---|---|
| 2,759,763 | A | | 8/1956 | Juvinall |
| 2,877,137 | A | | 3/1959 | Juvinall et al. |
| 2,890,388 | A | | 6/1959 | Croskey et al. |
| 2,955,565 | A | | 10/1960 | Schotland |
| 2,960,273 | A | | 11/1960 | Croskey et al. |
| 2,996,042 | A | | 8/1961 | Juvinall |
| 3,393,662 | A | | 7/1968 | Blackwell |
| 3,408,985 | A | * | 11/1968 | Sedlacsik, Jr. ..... 118/629 |
| 3,536,514 | A | | 10/1970 | La Fave et al. |
| 3,575,344 | A | | 4/1971 | Angelico |
| 3,589,607 | A | | 6/1971 | Wolf et al. |
| 3,608,823 | A | | 9/1971 | Buschor |
| 3,610,528 | A | | 10/1971 | Felici |
| 3,684,174 | A | | 8/1972 | Bein |
| 3,698,636 | A | | 10/1972 | Szasz |
| 3,843,054 | A | | 10/1974 | Kendall et al. |
| 3,851,618 | A | | 12/1974 | Bentley |
| 3,875,892 | A | | 4/1975 | Gregg et al. |
| 3,894,272 | A | | 7/1975 | Bentley |
| 3,913,523 | A | | 10/1975 | Probst et al. |
| 3,952,951 | A | | 4/1976 | Raetz et al. |
| 3,964,683 | A | | 6/1976 | Gimple |
| 4,037,561 | A | | 7/1977 | LaFave et al. |

(Continued)

FOREIGN PATENT DOCUMENTS

DE 101 29 667 A1 1/2003

(Continued)

OTHER PUBLICATIONS

Aerobell & Aerobell Plus Service Manual, 20 pages, 1992.

(Continued)

*Primary Examiner* — Dah-Wei Yuan
*Assistant Examiner* — Charles Capozzi
(74) *Attorney, Agent, or Firm* — Barnes & Thornburg LLP

(57) ABSTRACT

A coating material atomizing and dispensing system comprises an atomizer and an assembly of electrodes. The electrode assembly is removably coupled to the atomizer to permit the assembly to be disassembled from the atomizer to permit entry of the atomizer through an opening smaller than the atomizer-electrode assembly can pass through. A device is provided for supporting the assembly when the assembly is disassembled from the atomizer.

15 Claims, 2 Drawing Sheets

U.S. PATENT DOCUMENTS

| | | | | | |
|---|---|---|---|---|---|
| 4,066,041 | A | | 1/1978 | Buschor et al. | |
| 4,075,677 | A | | 2/1978 | Bentley | |
| 4,114,564 | A | | 9/1978 | Probst | |
| 4,114,810 | A | | 9/1978 | Masuda | |
| 4,135,667 | A | | 1/1979 | Benedek et al. | |
| 4,143,819 | A | | 3/1979 | Hastings | |
| 4,171,100 | A | | 10/1979 | Benedek et al. | |
| 4,187,527 | A | | 2/1980 | Bentley | |
| 4,214,708 | A | | 7/1980 | Lacchia | |
| 4,215,818 | A | | 8/1980 | Hopkinson | |
| 4,216,915 | A | | 8/1980 | Hengartner et al. | |
| 4,228,961 | A | | 10/1980 | Itoh | |
| 4,323,197 | A | | 4/1982 | Morishita et al. | |
| 4,324,812 | A | | 4/1982 | Bentley | |
| 4,350,304 | A | | 9/1982 | Sugiyama et al. | |
| 4,381,079 | A | | 4/1983 | Allen | |
| 4,402,991 | A | | 9/1983 | Meisner | |
| 4,422,577 | A | | 12/1983 | Arnold et al. | |
| RE31,590 | E | | 5/1984 | Mitsui | |
| 4,447,008 | A | | 5/1984 | Allen | |
| 4,450,785 | A | | 5/1984 | Meisner | |
| 4,481,557 | A | | 11/1984 | Woodruff | |
| 4,485,427 | A | | 11/1984 | Woodruff et al. | |
| RE31,867 | E | | 4/1985 | Kennon | |
| 4,518,119 | A | | 5/1985 | Vetter | |
| 4,726,521 | A | | 2/1988 | Simm et al. | |
| 4,745,520 | A | | 5/1988 | Hughey | |
| 4,760,965 | A | | 8/1988 | Schneider | |
| 4,771,949 | A | | 9/1988 | Behr et al. | |
| 4,779,805 | A | | 10/1988 | Jackson et al. | |
| 4,784,331 | A | | 11/1988 | Sharpless et al. | |
| 4,785,995 | A | | 11/1988 | Yamane et al. | |
| 4,788,933 | A | | 12/1988 | Buschor | |
| 4,802,625 | A | | 2/1989 | Buschor | |
| 4,811,898 | A | | 3/1989 | Murphy | |
| 4,852,810 | A | | 8/1989 | Behr et al. | |
| 4,872,616 | A | * | 10/1989 | Behr et al. | 239/703 |
| 4,879,137 | A | | 11/1989 | Behr et al. | |
| 4,890,190 | A | | 12/1989 | Hemming | |
| 4,896,384 | A | | 1/1990 | Dijkhuizen | |
| 4,943,005 | A | | 7/1990 | Weinstein | |
| 4,955,960 | A | | 9/1990 | Behr et al. | |
| 5,011,086 | A | | 4/1991 | Sonnleitner et al. | |
| 5,039,019 | A | | 8/1991 | Weinstein et al. | |
| 5,058,812 | A | | 10/1991 | Cox et al. | |
| 5,085,373 | A | * | 2/1992 | Behr et al. | 239/690 |
| 5,159,544 | A | | 10/1992 | Hughey et al. | |
| 5,353,995 | A | | 10/1994 | Chabert | |
| 5,433,387 | A | | 7/1995 | Howe et al. | |
| 5,582,347 | A | | 12/1996 | Knobbe et al. | |
| 5,622,563 | A | | 4/1997 | Howe et al. | |
| 5,633,306 | A | | 5/1997 | Howe et al. | |
| 5,662,278 | A | | 9/1997 | Howe et al. | |
| 5,720,436 | A | | 2/1998 | Buschor | |
| 5,803,372 | A | | 9/1998 | Weinstein et al. | |
| 5,826,795 | A | * | 10/1998 | Holland et al. | 239/318 |
| 5,853,126 | A | | 12/1998 | Alexander | |
| 5,957,395 | A | | 9/1999 | Howe et al. | |
| 5,978,244 | A | | 11/1999 | Hughey | |
| 6,012,657 | A | | 1/2000 | Knobbe et al. | |
| 6,042,030 | A | | 3/2000 | Howe et al. | |
| 6,076,751 | A | | 6/2000 | Austin et al. | |
| 6,144,570 | A | | 11/2000 | Hughey | |
| 6,230,993 | B1 | | 5/2001 | Austin et al. | |
| 6,328,224 | B1 | | 12/2001 | Alexander | |
| 6,423,142 | B1 | | 7/2002 | Hughey | |
| 6,537,378 | B1 | | 3/2003 | Mauchle | |
| 6,562,137 | B2 | | 5/2003 | Hughey | |
| 6,676,049 | B2 | | 1/2004 | van der Steur | |
| 6,708,908 | B2 | | 3/2004 | Heldt et al. | |
| 2003/0001031 | A1 | * | 1/2003 | Heldt et al. | 239/700 |
| 2004/0061007 | A1 | | 4/2004 | Milojevic et al. | |
| 2005/0035229 | A1 | | 2/2005 | Zhu et al. | |

FOREIGN PATENT DOCUMENTS

| | | | |
|---|---|---|---|
| EP | 0 171 042 | | 8/1985 |
| EP | 0 238 031 | | 3/1987 |
| EP | 0 333 040 | A2 | 3/1989 |
| EP | 1 566 222 | A1 | 8/2005 |
| EP | 1 634 651 | A1 | 3/2006 |
| EP | 1634651 | A1 * | 3/2006 |
| FR | 1 274 814 | | 11/1960 |
| GB | 1 209 653 | | 10/1970 |
| JP | 58-124560 | | 7/1983 |
| JP | 60-947166 | | 5/1985 |
| JP | 60-151554 | | 10/1985 |
| JP | 62-140660 | | 6/1987 |
| JP | 63-116776 | | 5/1988 |
| JP | 1-315361 | | 12/1989 |
| JP | 3-169361 | | 7/1991 |
| JP | 3-221166 | | 9/1991 |
| JP | 8010658 | A | 1/1996 |
| WO | 03/003175 | A1 | 4/2003 |
| WO | 2006/030991 | | 3/2006 |

OTHER PUBLICATIONS

"Aerobell Powder Applicator, State-of-the-Art Technology for Today's Powder Needs", 2 pages ITW Automotive Division, date unknown.

Canadian official action from CA 2,688,154 dated Aug. 31, 2011, 3 pages.

International search report and written opinion from PCT/US2008/067853 dated Jan. 26, 2009, 14 pages.

* cited by examiner

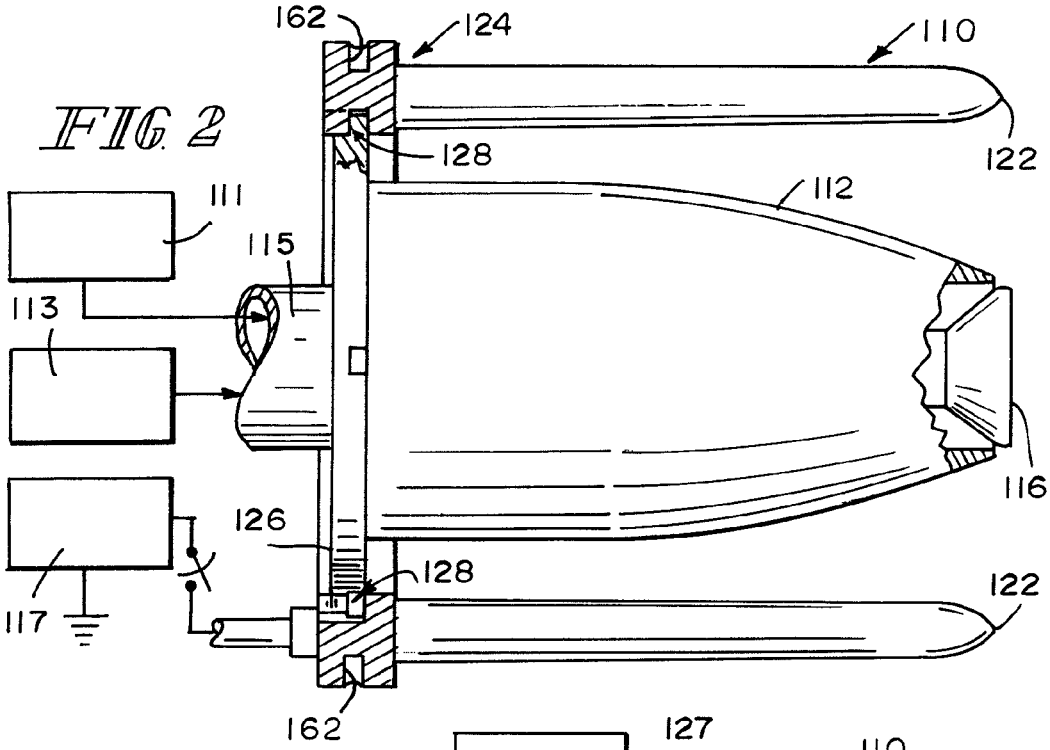
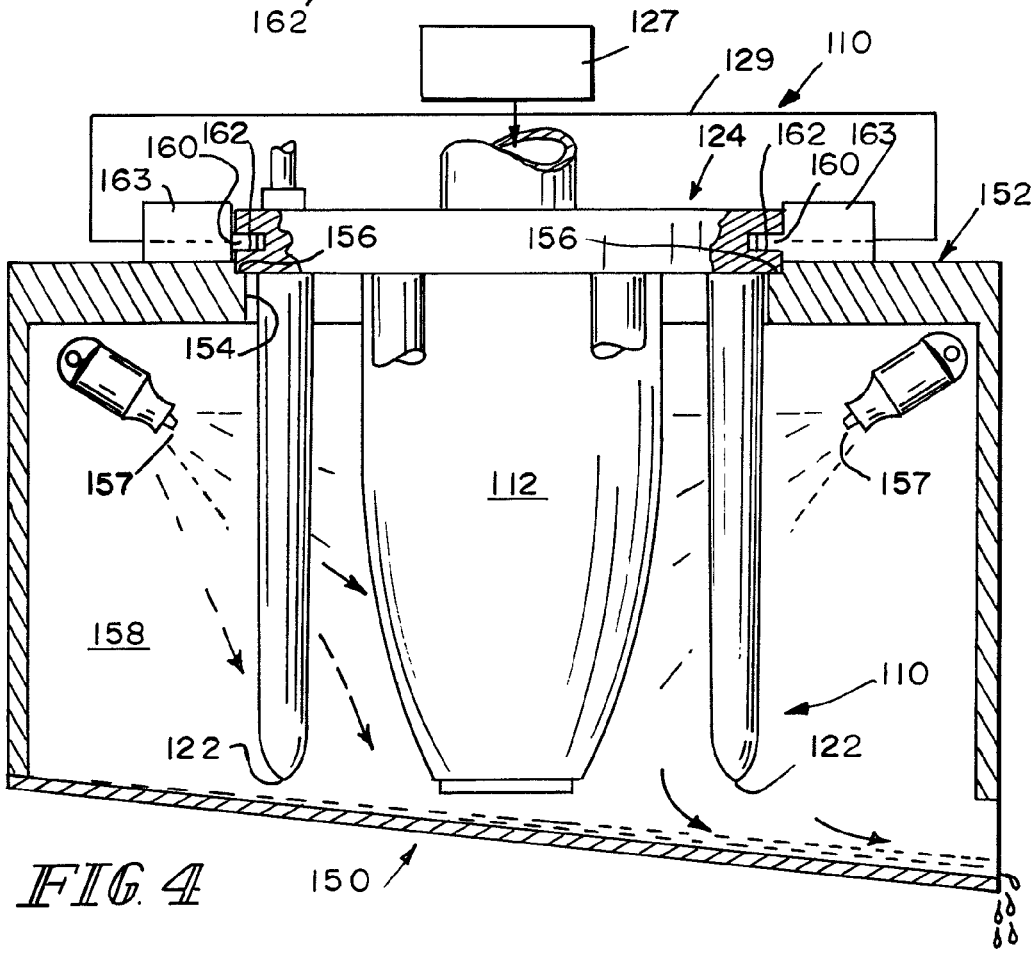
FIG. 4

COATING MATERIAL DISPENSING APPARATUS AND METHOD

CROSS-REFERENCE TO RELATED APPLICATION

This application claims the benefit of the filing date of UK provisional patent specification GB0625583.0 filed Dec. 21, 2006. The disclosure of GB0625583.0 is hereby incorporated herein by reference.

FIELD OF THE INVENTION

This invention relates to apparatus and methods for dispensing coating materials. It is disclosed in the context of an apparatus and method for dispensing electrically non-insulative coating material, and for indirectly charging the dispensed electrically non-insulative coating material. However, it is believed to be useful in other applications as well.

BACKGROUND OF THE INVENTION

As used in this application, materials described as "electrically conductive" and "electrically non-insulative" are characterized by conductivities in a broad range electrically more conductive than materials described as "electrically non-conductive" and "electrically insulative." Materials described as "electrically semiconductive" are characterized by conductivities in a broad range of conductivities between electrically conductive and electrically non-conductive. Terms such as "front," "back," "up," "down," and the like, are used only to describe illustrative embodiments, and are not intended as limiting.

Numerous devices for the coating of articles with atomized, electrostatically charged coating material particles are known. Generally, there are two types of such devices, ones in which the coating material particles are charged by direct contact with surfaces maintained at some non-zero magnitude electrical potential, sometimes called "direct charging," and ones in which the coating material particles are charged after they are atomized, sometimes called "indirect charging." Direct charging is typically used when the material being atomized is electrically non-conductive. The power supply which provides the charge to the direct charging apparatus will not be shorted to ground through the stream of coating material flowing to the atomizer. Indirect charging, on the other hand, typically is used in situations in which the material being atomized is electrically non-insulative, for example, when the material is waterborne, and would otherwise short the power supply which provides the charge to ground without the presence in the supply line between the coating material source and the atomizer of a so-called "voltage block."

Direct charging devices are illustrated and described in, for example, U.S. Pat. Nos. 3,536,514; 3,575,344; 3,608,823; 3,698,636; 3,843,054; 3,913,523; 3,964,683; 4,037,561; 4,114,564; 4,135,667; 4,216,915; 4,228,961; 4,381,079; 4,447,008; 4,450,785; Re. 31,867; 4,784,331; 4,788,933; 4,802,625; 4,811,898; 4,943,005; 5,353,995; 5,433,387; 5,582,347; 5,622,563; 5,633,306; 5,662,278; 5,720,436; 5,803,372; 5,853,126; 5,957,395; 6,012,657; 6,042,030; 6,076,751; 6,230,993; 6,328,224; 6,676,049; published U.S. patent applications: US 2004/0061007; US 2005/0035229; and WO 03/031075. There are also the devices illustrated and described in U.S. Pat. Nos. 2,759,763; 2,877,137; 2,955,565; 2,996,042; 3,589,607; 3,610,528; 3,684,174; 4,066,041; 4,171,100; 4,214,708; 4,215,818; 4,323,197; 4,350,304; 4,402,991; 4,422,577; Re. 31,590; 4,518,119; 4,726,521; 4,779,805; 4,785,995; 4,879,137; 4,890,190; 5,011,086; 5,058,812 and, 4,896,384; British Patent Specification 1,209,653; Japanese published patent applications: 62-140,660; 1-315,361; 3-169,361; 3-221,166; 60-151,554; 60-94,166; 63-116,776; PCT/JP2005/018045; and 58-124,560; and, French patent 1,274,814. There are also the devices illustrated and described in "Aerobell™ Powder Applicator ITW Automatic Division;" "Aerobell™ & Aerobell Plus™ Rotary Atomizer, DeVilbiss Ransburg Industrial Liquid Systems;" and, "Wagner PEM-C3 Spare parts list."

Indirect charging devices are illustrated and described in, for example, U.S. Pat. Nos. 5,085,373; 4,955,960; 4,872,616; 4,852,810; 4,771,949; 4,760,965; 4,143,819; 4,114,810; 3,408,985; 3,952,951; 3,393,662; 2,960,273; and, 2,890,388. Such devices typically provide an electric field through which atomized particles of the electrically non-insulative coating material pass between the atomizing device and the target to be coated by the atomized particles.

The disclosures of all of the cited references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a coating material atomizing and dispensing system comprises an atomizer and an assembly of electrodes. The electrode assembly is removably coupled to the atomizer to permit the assembly to be disassembled from the atomizer. This permits entry of the atomizer through an opening smaller than the atomizer-electrode assembly can pass through.

Illustratively, one of the electrode assembly and the atomizer includes a surface providing a groove. The groove includes a first portion and a second portion. The other of the electrode assembly and the atomizer includes a protrusion. Insertion of the protrusion into the first portion and subsequent relative manipulation of the atomizer and electrode assembly to move the protrusion into the second portion assembles the electrode assembly and the atomizer.

Illustratively, the atomizer includes the protrusion and the assembly includes the surface providing the groove.

Illustratively, the electrode assembly comprises a ring-shaped support and the electrodes extend generally in a common direction from a surface of the ring-shaped support.

Further illustratively, the apparatus includes a source of coating material to be atomized and dispensed, and a conduit for coupling the source of coating material to the atomizer.

Further illustratively, the apparatus includes a source of high magnitude potential and a conductor for coupling the source of high magnitude potential to the electrodes.

Further illustratively, the apparatus includes a device for supporting the assembly when the assembly is disassembled from the atomizer.

Further illustratively, the apparatus includes a device for supporting the assembly when the assembly is disassembled from the atomizer.

Illustratively, the device includes an interior into which at least a portion of the electrode assembly projects when the electrode assembly is disassembled from the atomizer. The interior includes at least one outlet for dispensing onto the at least a portion of the electrode assembly that projects into the interior an agent for removing coating material from the at least a portion of the electrode assembly that projects into the interior.

Illustratively, the device includes a mechanism actuable to attach the electrode assembly to the device to minimize the likelihood of accidental dislodgement of the electrode assembly from the device when the electrode assembly is disassembled from the atomizer.

BRIEF DESCRIPTION OF THE DRAWINGS

The invention may best be understood by referring to the following detailed descriptions and accompanying drawings. In the drawings:

FIG. 2 illustrates a partly fragmentary elevational view of a spray apparatus according to the present invention;

FIG. 4 illustrates a partly sectional elevational view of the spray apparatus illustrated in FIG. 2 in a docking station.

DETAILED DESCRIPTION OF ILLUSTRATIVE EMBODIMENTS

Figure 1:
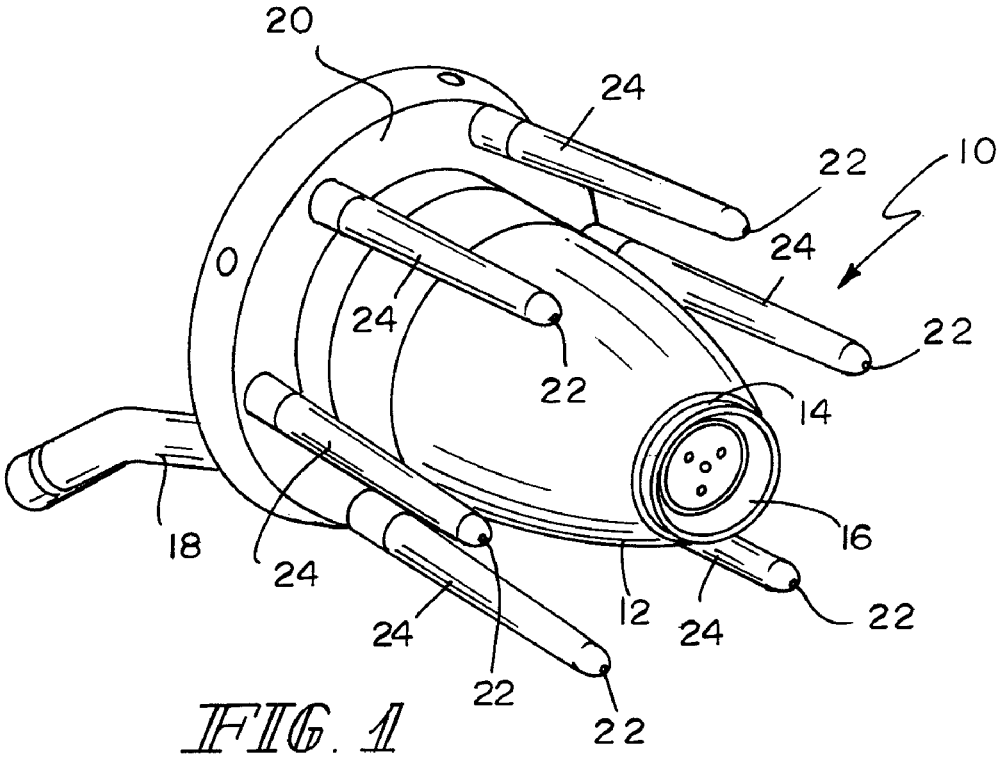
FIG. 1 illustrates a perspective view of a prior art spray apparatus.

Referring to FIG. 1, a known rotary atomizer 10 includes a housing 12 with an opening 14 through which a bell cup 16 dispenses atomized coating material. The cup 16 typically is mounted on the shaft (not shown) of a motor (not shown) such as, for example, a compressed air-driven turbine. In use, liquid coating material is supplied through a conduit 18 to the bell cup 16 and is atomized from a front edge of the bell cup 16 in accordance with known principles.

The housing 12 is mounted from a flange 20, which also supports an arrangement of electrodes 22. The electrodes 22 illustratively are equally angularly spaced around the rotational axis of the bell 16, here about 60° apart. A high magnitude potential is supplied to the electrode 22 array by a power supply such as, for example, one of the type illustrated and described in U.S. Pat. Nos. 6,562,137; 6,537,378; 6,423,142; 6,144,570; 5,978,244; 5,159,544; 4,745,520; 4,485,427; 4,481,557; 4,324,812; 4,187,527; 4,075,677; 3,894,272; 3,875,892; and, 3,851,618, so as to generate a corona adjacent the atomizer 10, such that the atomized coating material droplets leaving the edge of the bell 16 pass through the corona and thereby become electrostatically charged. The configuration of the electrodes 22 is exemplary only, and a variety of shapes, numbers and spacings of electrodes can be used to generate the discharge through which the droplets of coating material pass and are charged. The electrodes 22 are incorporated into an assembly 24 constructed from electrical insulating material. A high voltage is required to generate the corona, and the components supporting the electrodes 22 are designed and constructed to permit the dispensing of electrically non-insulative, for example, water-based coating materials.

In some coating installations, automotive vehicle coating plants being typical, atomizers 10 are typically mounted on the ends of robot arms. Such a robot arm is programmed to manipulate the atomizer 10 so as to spray coating material onto vehicles moving through the plant on a production line. The vehicle bodies typically are grounded or maintained at a low magnitude potential compared to the electrodes 22. The electrostatic force of attraction between the charged particles of coating material and the grounded or nearly grounded vehicle results in higher transfer efficiency of atomized coating material onto the vehicle.

As can be seen, the array of electrodes 22 adds considerably to the bulk, the physical envelope, of the apparatus 10, making it unwieldy, especially for use in confined spaces. In addition, manipulation by a robot of the atomizer 10 may cause soiling of the electrode surfaces by coating material. Accumulated coating material can adversely affect the ability of the electrodes 22 to generate the corona. For a robot-manipulated atomizer 10, soiling of the electrodes 22 by, for example, coating material, presents challenges.

Referring to FIG. 2, an atomizer 110 is similar to the atomizer 10 of FIG. 1, and equivalent features have similar reference numbers. Instead of a single flange 20, the housing 112 is mounted to a bulkhead 126, while the electrodes 122 are incorporated into an assembly 124. Detachment means 128 are provided for mounting the assembly 124 to the bulkhead 126. An illustrative "locate-and-twist" detachment means 128 is illustrated in FIG. 3.

The atomizer 110 is of a known design and includes a bell cup 116 which is driven to rotate by a motor housed in the housing 112. Separate lines supply coating material from a source 111 and compressed air from a source 113 to the atomizer 110 through the robot arm 115 and passages in the bulkhead 126. In use, the coating material is supplied to the bell cup 116. The bell cup 116 is driven by the motor to rotate at speeds sufficient to generate suitably sized droplets of the atomized coating material as described above for the apparatus of FIG. 1.

A high magnitude potential supply 117, illustratively of one of the types previously mentioned, is coupled through appropriate electrical connections to the electrodes 122 to generate a corona adjacent the atomizer 110 through which the atomized particles of coating material pass and are electrostatically charged.

Figure 3:
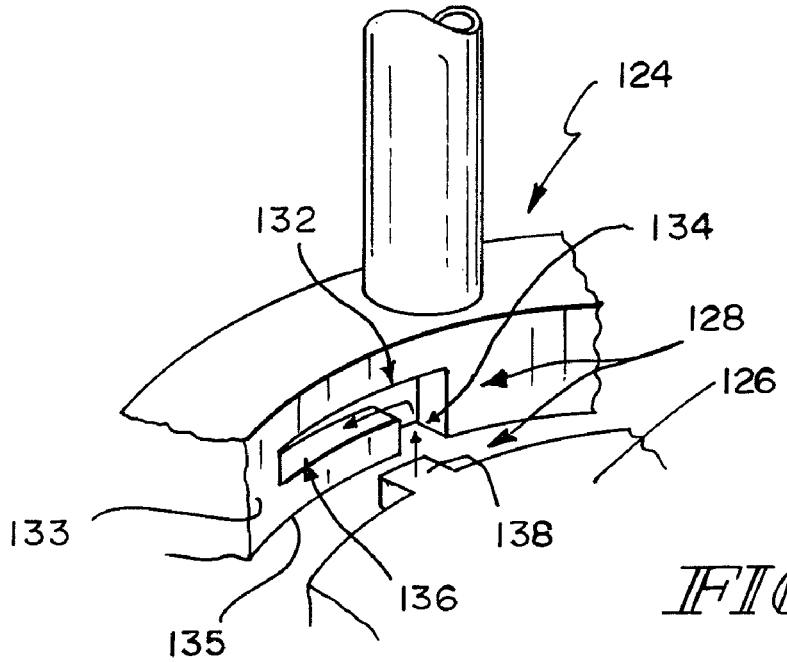
FIG. 3 illustrates a fragmentary perspective view of a detail of the spray apparatus illustrated in FIG. 2.

Referring to FIG. 3, an example of a locate-and-twist mechanism includes a groove 132 formed on a surface 133 of assembly 124. The groove 132 includes a first portion 134, which opens into a surface 135 of assembly 124. A second portion 136 of the groove 132 extends across the surface 133. The bulkhead 126 is provided with a tongue 138 which is complementarily sized to fit into the groove 132. To attach the assembly 124 to the bulkhead 126, the bulkhead 126 is moved to a position to locate the tongue 138 adjacent the first portion 134 of the groove 132. The bulkhead 126 is then moved until the tongue 138 has been pushed to the junction of the first 134 and second 136 portions of the groove 132, in this case, axially with respect to the atomizer 110. The bulkhead 126 is then rotated so that the tongue 138 is moved along the second portion 136 of the groove 132 to complete the mounting of the assembly 124 to the bulkhead 126. Detachment is accomplished by the reverse procedure.

FIG. 3 illustrates assembly 124 and bulkhead 126 only fragmentarily, showing only a single tongue 138 and groove 132. It will be appreciated that the atomizer 110 of FIG. 2 may include any suitable number, for example, two, three, four or six, of such locate-and-twist connections distributed in any suitable manner, for example, uniformly spaced or non-uniformly spaced, around the assembly 124 and the bulkhead 126.

In use, when it is required to use the atomizer 110 in a confined location such as, for example, to spray the interior or underside of a vehicle, the assembly 124 can be detached by disengagement of the assembly 124 from the bulkhead 126. By providing (a) simple detachment mechanism(s), such as the locate-and-twist mechanism illustrated in FIG. 3, the detachment operation can be easily automated by programming simple movement instructions (a twist movement, followed by an axial movement of bulkhead 126) into a robot arm controller to which the atomizer 110 is mounted.

As an alternative to the locate-and-twist mechanism, a remotely actuable mechanism may be provided. For example, one of the assembly 124 and bulkhead 126 can be provided with (a) suitably shaped recess(es), while the other of the assembly 124 and bulkhead 126 is provided with (a) complementarily shaped member(s) which is (are) adapted to be moved to engage in the recess(es). The movement may be provided, for example, by way of (an) electromechanical actuator(s), such as (a) relay(s) and plunger(s), electromagnet (s) that can be switched on to secure the assembly 124 to the bulkhead 126, and off to detach assembly 124 from bulkhead 126, and so on. Such switching may be under the control of a process controller 127 through, for example, a Controller Area Network bus (CANbus) 129 which can address the electromechanical actuator(s) to engage and disengage the assembly 124 to and from the bulkhead 126.

Referring to FIG. 4, a docking station 150 has a top surface 152 with an opening 154 into which the atomizer 110 can be inserted so that the outer dimensions of the assembly 124 rests on a ledge 156, while the housing 112 and the electrodes 122 extend through the opening into the interior 158 of station 150. A locking mechanism such as, for example, complementary remotely activated sliding pin(s) 160 and aligned hole(s) 162, is actuable to lock assembly 124 to station 150. Sliding pin(s) 160 may be remotely activated by means of, for example, process controller 127 through the CANbus 129. The pin(s) 160 may be activated by means of (a) solenoid(s) or similar device(s) 163.

Once locked by the locking mechanism, the housing 112 and the bulkhead 126 can be detached from the assembly 124 by actuation of the detachment means 128. The housing 112 and the bulkhead 126 can then be maneuvered away from the docking station 150, leaving the assembly 124 docked. The housing 112 can then be maneuvered into more confined spaces to continue dispensing of coating material without the bulkier envelope engendered by the assembly 124.

Cleaning nozzles 157 are provided in the interior 158 of the docking station 150, so that the entire assembly 110, 124 can be subjected to cleaning when it is in the orientation illustrated in FIG. 4 and/or so that assembly 124 can be subjected to cleaning while assembly 124 is in the docked position after housing 112 and bulkhead 126 have been maneuvered away from the docking station 150, leaving the assembly 124 docked.

An illustrative coating application process utilizing indirect charge technology with a coating robot utilizing an automatically detachable assembly 124 and an in-process applicator cleaner 150 includes the following process steps:

1. Spray (an) exterior surface(s) of an automotive vehicle with the assembly 110, 124 with an indirect charge process, running the electrode-to-target potential at, for example, 70 KV, electrode(s) 122 negative with respect to target vehicle;
2. Switch the high voltage, such that the electrode 122-to-target potential assumes, for example, 0 KV, and manipulate the coating robot 115 such that the atomizer 110 is presented at the docking station 150 for removal of the assembly 124. Manipulate the robot 115 and operate the controller 127 such that the assembly 124 is unlocked from the bulkhead 126 and supported on the docking station 150;
3. Move the coating robot 115 into position to resume coating the interior and cut-in areas of the target vehicle at 0 KV using the atomizer 110 with assembly 124 disassembled therefrom and left at the docking station 150;
4. Move the atomizer 110 to a separate cleaning station (not shown) and clean it, or move it back to the docking station 150, insert it through the assembly 124 into the interior of the docking station 150, and clean the atomizer 110 and reattach the assembly 124;
5. Move the coating robot 115 into position to resume coating the exterior of the next vehicle to be conveyed through the coating application space, switch the high voltage supply 117 to the assembly 124 back on, switch on the supplies 111, 113 of compressed air (where compressed air is used in atomization and dispensing of coating material) and of the next coating material to be dispensed on, and resume coating.

What is claimed is:

1. A coating material atomizing and dispensing apparatus comprising an atomizer including a bulkhead having a first diameter, an electrode assembly including a base and a plurality of electrodes, each electrode extending from the base to a tip, the base having a second diameter larger than the first diameter and configured to be coupled to a supporting assembly, one of the base and the bulkhead including a first surface facing the other of the base and the bulkhead and providing a groove, the groove including a first portion extending axially of the atomizer and a second portion extending circumferentially of the apparatus, and the other of the base and the bulkhead including a protrusion on a surface thereof facing the first surface, insertion of the protrusion into the first portion and subsequent relative rotation of the bulkhead and base to move the protrusion into the second portion assembling the assembly and the atomizer to permit the atomizer to be disassembled from the base of the assembly, wherein the disassembled atomizer has a maximum diameter smaller than the second diameter to permit entry of the atomizer through an opening smaller than the atomizer-electrode assembly can pass through.

2. The apparatus of claim 1 wherein the bulkhead includes the protrusion and the electrode assembly base includes the surface providing the groove.

3. The apparatus of claim 1 wherein the electrode assembly base comprises a ring-shaped support providing the first surface, with the electrodes extending generally in a common direction from a second surface thereof.

4. The apparatus of claim 1 further including a source of coating material to be atomized and dispensed, and a conduit for coupling the source of coating material to the atomizer.

5. The apparatus of claim 1 further including a source of high magnitude potential and a conductor for coupling the source of high magnitude potential to the electrodes.

6. The apparatus of claim 1 further including a device for supporting the assembly when the assembly is disassembled from the atomizer.

7. The apparatus of claim 6 wherein the device includes an interior into which at least a portion of the assembly including the electrodes projects when the assembly is disassembled from the atomizer, the interior including at least one outlet for dispensing an agent for removing coating material from the at least a portion of the assembly that projects into the interior onto the at least a portion of the assembly that projects into the interior.

8. The apparatus of claim 7 wherein the device includes a mechanism actuable to attach the assembly to the device to minimize the likelihood of accidental dislodgement of the assembly from the device when the assembly is disassembled from the atomizer.

9. A coating material atomizing and dispensing system comprising a supporting assembly, an atomizer including a bulkhead having a first diameter, an electrode assembly including a base and a plurality of electrodes, each electrode extending from the base to a tip, the base having a second diameter larger than the first diameter and configured to be coupled to the supporting assembly, one of the base and the bulkhead including a first surface facing the other of the electrode assembly and the bulkhead and providing a groove, the groove including a first portion extending axially of the atomizer and a second portion extending circumferentially of the atomizer, and the other of the base and the bulkhead including a protrusion on a surface thereof facing the first surface, insertion of the protrusion into the first portion and subsequent relative rotation of the bulkhead and base to move the protrusion into the second portion assembling the electrode assembly and the atomizer to permit the atomizer to be disassembled from the base, wherein the disassembled atomizer has a maximum diameter smaller than the second diameter to permit entry of the atomizer through an opening smaller than the atomizer-electrode assembly can pass through, the supporting assembly for supporting the electrode assembly when the electrode assembly is disassembled from the atomizer.

10. The system of claim 9 wherein the supporting assembly includes an interior into which at least a portion of the electrode assembly projects when the electrode assembly is disassembled from the atomizer, the interior including at least one outlet for dispensing an agent for removing coating material from the at least a portion of the electrode assembly that projects into the interior onto the at least a portion of the electrode assembly that projects into the interior.

11. The system of claim 10 wherein the supporting assembly includes a mechanism actuable to attach the electrode assembly to the supporting assembly to minimize the likelihood of accidental dislodgement of the electrode assembly from the supporting assembly when the electrode assembly is disassembled from the atomizer.

12. The apparatus of claim 9 wherein the bulkhead of the atomizer includes the protrusion and the base of the electrode assembly includes the first surface providing the groove.

13. The apparatus of claim 9 wherein the electrode assembly base comprises a ring-shaped support providing the first surface, with the electrodes extending generally in a common direction from a second surface thereof.

14. The apparatus of claim 9 further including a source of coating material to be atomized and dispensed, and a conduit for coupling the source of coating material to the atomizer.

15. The apparatus of claim 9 further including a source of high magnitude potential and a conductor for coupling the source of high magnitude potential to the electrodes.

* * * * *